US009562424B2

(12) United States Patent
Bilozir et al.

(10) Patent No.: US 9,562,424 B2
(45) Date of Patent: Feb. 7, 2017

(54) WASTE HEAT RECOVERY FROM DEPLETED RESERVOIR

(71) Applicant: Cenovus Energy Inc., Calgary (CA)

(72) Inventors: Mark Bilozir, Calgary (CA); Christian Canas, Calgary (CA); Carlos Emilio Perez Damas, Calgary (CA); Arun Sood, Calgary (CA)

(73) Assignee: Cenovus Energy Inc. (CA)

( * ) Notice: Subject to any disclaimer, the term of this patent is extended or adjusted under 35 U.S.C. 154(b) by 0 days.

(21) Appl. No.: 14/549,493

(22) Filed: Nov. 20, 2014

(65) Prior Publication Data

US 2015/0144337 A1 May 28, 2015

Related U.S. Application Data

(60) Provisional application No. 61/907,969, filed on Nov. 22, 2013.

(51) Int. Cl.

| | |
|---|---|
| ***E21B 43/24*** | (2006.01) |
| ***E21B 43/243*** | (2006.01) |
| ***E21B 43/16*** | (2006.01) |
| ***E21B 43/247*** | (2006.01) |

(52) U.S. Cl.
CPC ..... *E21B 43/2406* (2013.01); *E21B 43/166* (2013.01); *E21B 43/243* (2013.01); *E21B 43/247* (2013.01)

(58) Field of Classification Search
None
See application file for complete search history.

(56) References Cited

U.S. PATENT DOCUMENTS

| | | | | |
|---|---|---|---|---|
| 3,159,215 | A | | 12/1964 | Meldau et al. |
| 3,294,167 | A | * | 12/1966 | Vogel ..... 166/272.1 |
| 3,349,843 | A | | 10/1967 | Huitt |
| 3,379,248 | A | * | 4/1968 | Strange ..... 166/256 |
| 3,432,205 | A | | 3/1969 | Hottman et al. |
| 3,441,083 | A | | 4/1969 | Fitzgerald |
| 3,515,212 | A | | 6/1970 | Allen et al. |
| 3,620,302 | A | | 11/1971 | Parsons |
| 3,827,243 | A | | 8/1974 | Paull et al. |

(Continued)

FOREIGN PATENT DOCUMENTS

| | | |
|---|---|---|
| CA | 1059896 | 8/1979 |
| CA | 1088414 | 10/1980 |

(Continued)

OTHER PUBLICATIONS

U.S. Appl. No. 14/549,479, filed Nov. 20, 2014, Bilozir et al.
Office Action issued on Feb. 1, 2016 in U.S. Appl. No. 14/549,479.

*Primary Examiner* — Angela M DiTrani
*Assistant Examiner* — Anuradha Ahuja
(74) *Attorney, Agent, or Firm* — Knobbe Martens Olson & Bear LLP

(57) ABSTRACT

A method of producing heated water from a reservoir having a hot bitumen-depleted zone adjacent to an aqueous mobile zone. The method includes generating fluid communication between the aqueous mobile zone and the hot bitumen-depleted zone. The method further includes driving water from the aqueous mobile zone through a portion of the hot bitumen-depleted zone to heat the water to produce heated water from a heated water production well.

18 Claims, 13 Drawing Sheets

(56) References Cited

U.S. PATENT DOCUMENTS

| | | | | |
|---|---|---|---|---|
| 3,863,709 | A * | 2/1975 | Fitch | 165/45 |
| 3,872,924 | A | 3/1975 | Clampitt | |
| 3,972,372 | A * | 8/1976 | Fisher et al. | 166/248 |
| 4,015,663 | A * | 4/1977 | Strubhar | 166/258 |
| 4,019,577 | A | 4/1977 | Fitch et al. | |
| 4,043,393 | A * | 8/1977 | Fisher et al. | 166/248 |
| 4,059,152 | A | 11/1977 | Allen et al. | |
| 4,089,373 | A * | 5/1978 | Reynolds et al. | 166/256 |
| 4,099,566 | A * | 7/1978 | Redford | 166/260 |
| 4,112,745 | A * | 9/1978 | McCabe et al. | 60/641.2 |
| 4,133,384 | A | 1/1979 | Allen et al. | |
| 4,178,039 | A * | 12/1979 | Burton, III | 299/2 |
| 4,223,729 | A * | 9/1980 | Foster | 166/271 |
| 4,319,635 | A | 3/1982 | Jones | |
| 4,344,485 | A | 8/1982 | Butler | |
| 4,410,216 | A | 10/1983 | Allen | |
| 4,493,369 | A | 1/1985 | Odeh et al. | |
| 4,495,994 | A | 1/1985 | Brown et al. | |
| 4,566,537 | A | 1/1986 | Gussis | |
| 4,612,990 | A | 9/1986 | Shu | |
| 4,903,768 | A | 2/1990 | Shu | |
| 4,961,467 | A | 10/1990 | Pebdani | |
| 5,211,230 | A | 5/1993 | Ostapovich et al. | |
| 5,305,829 | A * | 4/1994 | Kumar | 166/245 |
| 5,456,315 | A | 10/1995 | Kisman et al. | |
| 5,515,679 | A * | 5/1996 | Shulman | 60/641.2 |
| 5,626,191 | A | 5/1997 | Greaves et al. | |
| 5,685,362 | A | 11/1997 | Brown | |
| 5,765,964 | A | 6/1998 | Calcote et al. | |
| 6,247,313 | B1 * | 6/2001 | Moe et al. | 60/641.2 |
| 6,412,557 | B1 | 7/2002 | Ayasse et al. | |
| 7,516,789 | B2 | 4/2009 | Chhina et al. | |
| 7,581,587 | B2 | 9/2009 | Pfefferle | |
| 7,740,062 | B2 | 6/2010 | Lim et al. | |
| 7,753,122 | B2 | 7/2010 | Curlett | |
| 8,020,382 | B1 * | 9/2011 | Zakiewicz | 60/641.2 |
| 8,109,094 | B2 | 2/2012 | Petty | |
| 8,176,980 | B2 | 5/2012 | Sanmiguel et al. | |
| 8,215,104 | B2 | 7/2012 | Riley | |
| 8,297,355 | B2 | 10/2012 | Hamilton et al. | |
| 2004/0244990 | A1 * | 12/2004 | Herr | 166/370 |
| 2006/0026961 | A1 * | 2/2006 | Bronicki | 60/641.2 |
| 2007/0223999 | A1 * | 9/2007 | Curlett | 405/55 |
| 2008/0264635 | A1 | 10/2008 | Chhina et al. | |
| 2009/0044940 | A1 | 2/2009 | Pfefferle | |
| 2010/0096126 | A1 | 4/2010 | Sullivan et al. | |
| 2010/0258308 | A1 * | 10/2010 | Speirs et al. | 166/272.3 |
| 2013/0118737 | A1 * | 5/2013 | Schneider et al. | 166/272.3 |
| 2013/0234444 | A1 * | 9/2013 | Rogers et al. | 290/1 R |
| 2014/0216739 | A1 * | 8/2014 | Brown et al. | 166/272.3 |

FOREIGN PATENT DOCUMENTS

| | | |
|---|---|---|
| CA | 1088861 | 11/1980 |
| CA | 1304287 | 6/1992 |
| CA | 2015459 | 8/1995 |
| CA | 2096034 | 7/1996 |
| CA | 2678347 | 9/2010 |
| CA | 2594414 | 10/2010 |
| CA | 2698454 | 11/2011 |
| CA | 2594413 | 5/2012 |
| CA | 2753393 | 9/2013 |
| CA | 2692204 | 1/2014 |
| EP | 1586830 A1 | 10/2005 |

* cited by examiner

WASTE HEAT RECOVERY FROM DEPLETED RESERVOIR

INCORPORATION BY REFERENCE OF PRIORITY APPLICATIONS

This application claims the benefit of priority of U.S. Provisional Patent Application No. 61/907,969 filed Nov. 22, 2013, which is hereby incorporated by reference.

FIELD

The present disclosure relates generally to methods of producing heat from a depleted reservoir.

BACKGROUND

A variety of processes are used to recover viscous hydrocarbons, such as heavy oils and bitumen, from reservoirs such as oil sands deposits. Extensive deposits of viscous hydrocarbons exist around the world, including large deposits in the Northern Alberta oil sands that are not susceptible to standard oil well production technologies. One problem associated with producing hydrocarbons from such deposits is that the hydrocarbons are too viscous to flow at commercially relevant rates at the temperatures and pressures present in the reservoir.

In some cases, such deposits are mined using open-pit mining techniques to extract hydrocarbon-bearing material for later processing to extract the hydrocarbons. Alternatively, thermal techniques may be used to heat the hydrocarbon reservoir to mobilize the hydrocarbons and produce the heated, mobilized hydrocarbons from wells.

One thermal method of recovering viscous hydrocarbons using two vertically spaced horizontal wells is known as steam-assisted gravity drainage (SAGD). Various embodiments of the SAGD process are described in Canadian Patent No. 1,304,287 and corresponding U.S. Pat. No. 4,344,485. In the SAGD process, steam is pumped through an upper, horizontal, injection well into a viscous hydrocarbon reservoir while mobilized hydrocarbons are produced from a lower, parallel, horizontal, production well that is vertically spaced and near the injection well. The injection and production wells are located close to the bottom of the hydrocarbon deposit to collect the hydrocarbons that flow toward the bottom.

The SAGD process is believed to work as follows. The injected steam initially mobilizes the hydrocarbons to create a steam chamber in the reservoir around and above the horizontal injection well. The term "steam chamber" is utilized to refer to the volume of the reservoir that is saturated with injected steam and from which mobilized oil has at least partially drained. As the steam chamber expands upwardly and laterally from the injection well, viscous hydrocarbons in the reservoir are heated and mobilized, in particular, at the margins of the steam chamber where the steam condenses and heats the viscous hydrocarbons by thermal conduction. The mobilized hydrocarbons and aqueous condensate drain, under the effects of gravity, toward the bottom of the steam chamber, where the production well is located. The mobilized hydrocarbons are collected and produced from the production well. The rate of steam injection and the rate of hydrocarbon production may be modulated to control the growth of the steam chamber and ensure that the production well remains located at the bottom of the steam chamber in an appropriate position to collect mobilized hydrocarbons.

In situ Combustion (ISC) is another thermal method which may be utilized to recover hydrocarbons from underground hydrocarbon reservoirs. ISC includes the injection of an oxidizing gas into the porous rock of a hydrocarbon-containing reservoir to ignite and support combustion of the hydrocarbons around the wellbore. ISC may be initiated using an artificial igniter such as a downhole heater or by pre-conditioning the formation around the wellbores and promoting spontaneous ignition. The ISC process, also known as fire flooding or fireflood, is sustained and the ISC fire front moves due to the continuous injection of the oxidizing gas. The heat generated by burning the heavy hydrocarbons in place produces hydrocarbon cracking, vaporization of light hydrocarbons and reservoir water in addition to the deposition of heavier hydrocarbons known as coke. As the fire moves, the burning front pushes a mixture of hot combustion gases, steam, and hot water, which in turn reduces oil viscosity and the oil moves toward the production well. Additionally, the light hydrocarbons and the steam move ahead of the burning front, condensing into liquids, facilitating miscible displacement and hot waterflooding, which contribute to the recovery of hydrocarbons.

Canadian Patent 2,096,034 to Kisman et al. and U.S. Pat. No. 5,211,230 to Ostapovich et al. disclose a method of in situ combustion for the recovery of hydrocarbons from underground reservoirs, sometimes referred to as Combustion Split production Horizontal well Process (COSH) or Combustion Overhead Gravity Drainage (COGD). The disclosed processes include gravity drainage to a basal horizontal well in a combustion process. A horizontal production well is located in the lower portion of the reservoir. A vertical injection and one or more vertical vent wells are provided in the upper portion of the reservoir. Oxygen-enriched gas is injected down the injector well and ignited in the upper portion of the reservoir to create a combustion zone that reduces viscosity of oil in the reservoir as the combustion zone advances downwardly toward the horizontal production well. The reduced-viscosity oil drains into the horizontal production well under the force of gravity.

Canadian Patent 2,678,347 to Bailey discloses a pre-ignition heat cycle (PIHC) using cyclic steam injection and steam flood methods that improve the recovery of viscous hydrocarbons from a subterranean reservoir using an overhead in situ combustion process, referred to as combustion overhead gravity drainage (COGD). Bailey discloses a method where the reservoir well network includes one or more injection wells and one or more vent wells located in the top portion of the reservoir, and where the horizontal drain is located in the bottom portion of the reservoir.

The use of ISC as a follow up process to SAGD is disclosed in Canadian Patent 2,594,414 to Chhina et al. The disclosed hydrocarbon recovery processes may be utilized in hydrocarbon reservoirs. Chhina discloses a process where a former steam injection well, used during the preceding SAGD recovery process, is used as an oxidizing gas injection well and where another former steam injection well, adjacent to the oxidizing gas injection well, is converted into a combustion gas production well. This results in the horizontal hydrocarbon production well being located below the horizontal oxidizing gas injection well and at least one combustion gas production well being spaced from the injection well by a distance that is greater than the spacing between hydrocarbon production well and the oxidizing gas injection well. Since the process disclosed by Chhina uses at least two wells pairs, ISC is initiated after the production well is sufficiently depleted of hydrocarbons to establish communication between the two well pairs.

Hydrocarbon reservoirs may exist substantially in isolation, or may also exist adjacent to aqueous mobile fluid zone formations that have relatively low bitumen saturation and significant saturations of water. In such deposits, these aqueous mobile fluid zone formations can act as a "thief zone" and have one or more undesirable effects on recovery methods. For example, if this adjacent aqueous mobile fluid zone is in fluid communication with the reservoir being recovered, the adjacent aqueous mobile fluid zone may detrimentally absorb heat which would otherwise be used in the thermal recovery process to produce hydrocarbons.

SUMMARY

In a first aspect, the present disclosure provides a method of producing heated water from a hydrocarbon reservoir having a hot bitumen-depleted zone adjacent to an aqueous mobile zone. The method includes generating fluid communication between the aqueous mobile zone and the hot bitumen-depleted zone; driving water from the aqueous mobile zone through at least a portion of the hot bitumen-depleted zone to heat the water; and producing the heated water from a heated water production well.

The method may also include generating the hot bitumen-depleted zone using steam-assisted gravity drainage, in situ combustion, steam flooding, cyclic steam stimulation, a solvent aided thermal recovery process, electric heating, electromagnetic heating, or any combination thereof.

Driving the water from the aqueous mobile zone through at least a portion of the hot bitumen-depleted zone may heat the water sufficiently to generate steam in situ. The steam may be superheated steam. When generating steam in situ, for example superheated steam, the heated water production well may be located above at least a portion of the hot bitumen-depleted zone, and the water from the aqueous mobile zone may be driven though the portion of the hot-bitumen depleted zone below the heated water production well.

Driving the water from the aqueous mobile zone through at least a portion of the hot bitumen-depleted zone may heat the water sufficiently to generate hot liquid water in situ. When generating hot liquid water, the heated production well may be located below at least a portion of the hot bitumen-depleted zone, and the water from the aqueous mobile zone may be driven though the portion of the hot-bitumen depleted zone above the heated water production well.

Driving the water from the aqueous mobile zone through at least a portion of the hot bitumen-depleted zone may heat the water sufficiently to generate both unsaturated steam and hot liquid water in situ. Such a mixture of unsaturated steam and hot liquid water may be referred to as saturated steam. When generating both steam and hot liquid water, the method may include producing heated water from a first and a second heated water production well. In such situations, the first heated water production well is located above at least a portion of the hot bitumen-depleted zone; and the second heated water production well is located below at least a portion of the hot bitumen-depleted zone. The water from the aqueous mobile zone is driven though a portion of the hot-bitumen depleted zone below the first heated water production well and above the heated water production well, and the first heated water production well produces heated water from the generated steam, and the second heated water production well produces water from the generated hot liquid water.

The method may include applying a pressure difference between the aqueous mobile zone and the heated water production well to drive the water from the aqueous mobile zone through the at least a portion of the hot bitumen-depleted zone. The pressure difference may be applied by injecting a gas or liquid into the aqueous mobile zone. The pressure difference may be applied by reducing the pressure at the heated water production well. The pressure difference may be applied by an increased pressure exerted by the aqueous mobile zone. The pressure difference may be applied by gravity. The method may avoid the injection of a gas or liquid into the aqueous mobile zone.

The hot bitumen-depleted zone may be separated from the aqueous mobile zone by a geological barrier, and generating fluid communication between the aqueous mobile zone and the hot bitumen-depleted zone may include modifying the geological barrier to allow the aqueous mobile zone to flow through the modified geological barrier. The geological barrier may be a rock formation and modifying the geological barrier may include fracturing a sufficient portion of the rock formation to allow water from the aqueous zone to flow to the hot bitumen-depleted zone. Modifying the geological barrier may include drilling a well that generates the fluid communication between the aqueous mobile zone and the hot bitumen-depleted zone.

The hot bitumen-depleted zone may be separated from the aqueous mobile zone by a geological barrier that prevents flow of water there through, and generating fluid communication between the aqueous mobile zone and the hot bitumen-depleted zone may include modifying the geological barrier. The geological barrier may include bitumen and modifying the geological barrier may include sufficiently decreasing the viscosity of the bitumen so that water from the aqueous mobile zone is flowable through the geological barrier to the hot bitumen-depleted zone.

Some embodiments described herein include a method of producing heated water from a hydrocarbon reservoir having a hot bitumen-depleted zone adjacent to an aqueous mobile zone, the method comprising: generating fluid communication between the aqueous mobile zone and the hot bitumen-depleted zone; driving water from the aqueous mobile zone through at least a portion of the hot bitumen-depleted zone to heat the water; and producing the heated water from a heated water production well.

In some embodiments, the method comprises generating the hot bitumen-depleted zone using steam-assisted gravity drainage, in situ combustion, steam flooding, cyclic steam stimulation, a solvent aided thermal recovery process, electric heating, electromagnetic heating, or any combination thereof.

In some embodiments, driving the water from the aqueous mobile zone through at least a portion of the hot bitumen-depleted zone heats the water sufficiently to generate steam in situ.

In some embodiments, the heated water production well is located above at least a portion of the hot bitumen-depleted zone, and the water from the aqueous mobile zone is driven though the portion of the hot-bitumen depleted zone below the heated water production well.

In some embodiments, driving the water from the aqueous mobile zone through at least a portion of the hot bitumen-depleted zone heats the water sufficiently to generate hot liquid water in situ.

In some embodiments, the heated water production well is located below at least a portion of the hot bitumen-depleted zone, and the water from the aqueous mobile zone is driven though the portion of the hot-bitumen depleted zone above the heated water production well.

In some embodiments, driving the water from the aqueous mobile zone through at least a portion of the hot bitumen-depleted zone heats the water sufficiently to generate both steam and hot liquid water in situ.

In some embodiments, the method comprises producing heated water from a first and a second heated water production well, wherein the first heated water production well is located above at least a portion of the hot bitumen-depleted zone; and the second heated water production well is located below at least a portion of the hot bitumen-depleted zone; and the water from the aqueous mobile zone is driven though a portion of the hot-bitumen depleted zone below the first heated water production well and above the heated water production well, and the first heated water production well produces heated water from the generated steam, and the second heated water production well produces water from the generated hot liquid water.

In some embodiments, the method further comprises applying a pressure difference between the aqueous mobile zone and the heated water production well to drive the water from the aqueous mobile zone through the at least a portion of the hot bitumen-depleted zone.

In some embodiments, the pressure difference is applied by: injecting a gas or liquid into the aqueous mobile zone, reducing the pressure at the heated water production well, an increased pressure exerted by the aqueous mobile zone, gravity, or any combination thereof.

In some embodiments, the method avoids the injection of a gas or liquid into the aqueous mobile zone.

In some embodiments, the hot bitumen-depleted zone is separated from the aqueous mobile zone by a geological barrier, and generating fluid communication between the aqueous mobile zone and the hot bitumen-depleted zone comprises modifying the geological barrier to allow the aqueous mobile zone to flow through the modified geological barrier.

In some embodiments, the geological barrier comprises a lithology contrast, a fault, a fluid compositional gradient, a tar mat, a rock formation, bitumen, or any combination thereof.

In some embodiments, the geological barrier is a rock formation and modifying the geological barrier comprises fracturing a sufficient portion of the rock formation to allow water from the aqueous zone to flow to the hot bitumen-depleted zone.

In some embodiments, the geological barrier comprises bitumen and modifying the geological barrier comprises sufficiently decreasing the viscosity of the bitumen so that water from the aqueous mobile zone is flowable through the geological barrier to the hot bitumen-depleted zone.

In some embodiments, modifying the geological barrier comprises drilling a well that generates the fluid communication between the aqueous mobile zone and the hot bitumen-depleted zone.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Figure 1:
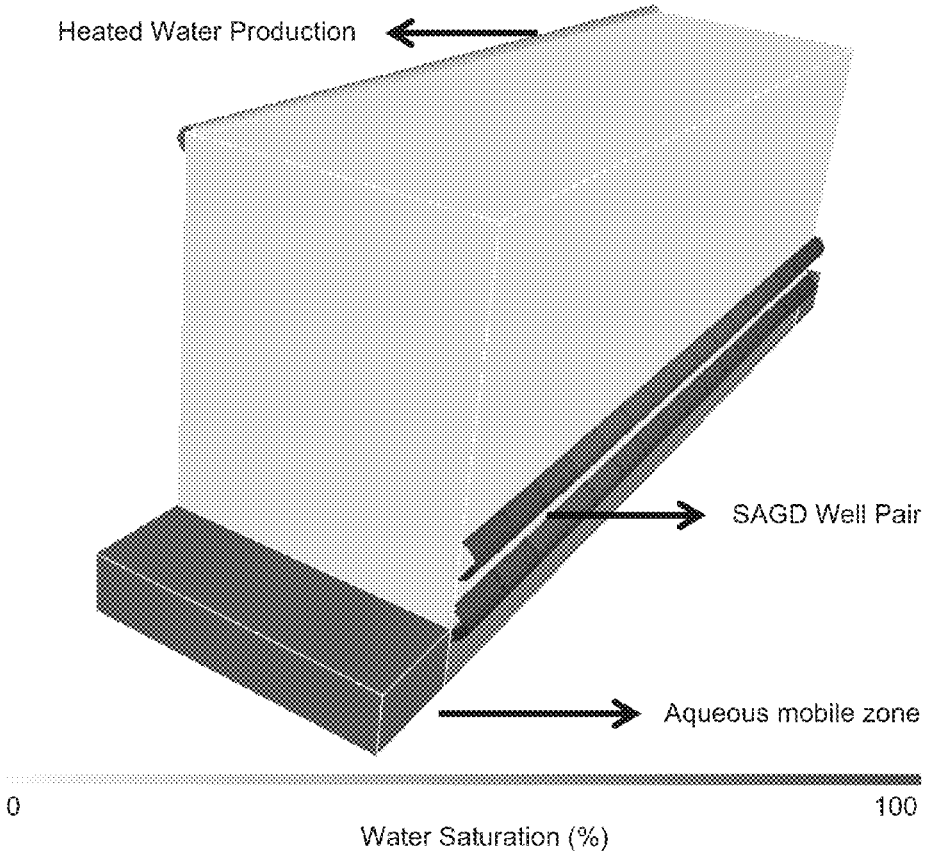
FIG. 1 is an illustration of a simulated reservoir, with the grayscale illustrating the water saturation of each simulated cell.

Generally, the present disclosure provides a method of producing heated water from a hydrocarbon reservoir having a hot bitumen-depleted zone adjacent to an aqueous mobile zone. The method includes: generating fluid communication between the aqueous mobile zone and the hot bitumen-depleted zone; driving water from the aqueous mobile zone through at least a portion of the hot bitumen-depleted zone to heat the water; and producing the heated water from a heated water production well.

In the context of the present disclosure, an aqueous mobile zone is considered to be adjacent to a hot bitumen-depleted zone if fluid communication is able to be generated between the aqueous mobile zone and the hot bitumen-depleted zone. Fluid communication should be understood to mean that water in the aqueous mobile zone is flowable through a geological formation to the hot bitumen-depleted zone.

Aqueous mobile zones may contain dissolved salts, minerals, or combinations thereof. These aqueous mobile zones may be referred to as aquifers or water-filled rock formations. The dissolved salts or minerals reduce the likelihood that the water contained in the aqueous mobile zone could be used for consumption or irrigation. Accordingly, when compared to surface fluid that could be used for consumption or irrigation, it may be more economically beneficial to use fluid from an aqueous mobile zone that has dissolved salts or minerals to recover waste heat from the hot bitumen-depleted zone.

For example, depleted hydrocarbon reservoirs may have a hot bitumen-depleted zone that is separated from the aqueous mobile zone by a geological barrier. In such a situation, fluid communication may be generated by modifying the geological barrier to allow the aqueous mobile zone to flow through the modified geological barrier. In another example, depleted hydrocarbon reservoirs may have a hot bitumen-depleted zone that is separated from the aqueous mobile zone by a geological barrier that prevents flow of water there through. The geological barrier may include, for example, a fluid barrier of a viscous fluid such as bitumen. In such a situation, fluid communication may be generated by changing the geological barrier, for example by decreasing the viscosity of the bitumen separating the two zones, and allowing the aqueous mobile zone to flow through the geological barrier.

In some specific examples, the geological barrier may be the result of a lithology contrast and modifying the permeability of the formation to generate fluid communication may be accomplished by, for example: fracturing a sufficient portion of the formation to allow water from the aqueous zone to flow to the hot bitumen-depleted zone.

At least a portion of the aqueous mobile zone may be below the hot bitumen-depleted zone, above the hot bitumen-depleted zone, beside the hot bitumen-depleted zone, or any combination thereof.

In the context of the present disclosure, driving water from the aqueous mobile zone through at least a portion of the hot bitumen-depleted zone should be understood to refer to causing movement of the water through the hot bitumen-depleted zone.

Driving the water from a first location to a second location may be due to, for example: a pressure difference between two locations. It should be noted that a pressure differential may develop between the adjacent aqueous mobile zone and the reservoir as reservoir fluids are produced and reservoir pressure declines. However, if the pore volume of the aqueous mobile zone is not sufficiently large, or if the permeability is too low, an increase in the pressure differential may be required before water in the aqueous mobile zone penetrates into the hot bitumen-depleted zone.

Water in the aqueous mobile zone may be induced to flow, for example, under the application of a pressure difference between the aqueous mobile zone and the heated water production well, by injecting a gas or liquid into the aqueous mobile zone, by reducing the pressure at the heated water production well, by an increased pressure exerted by the aqueous mobile zone, by gravity driving water through the hot bitumen-depleted zone from the top to the bottom, or any combination thereof. In some examples, not injecting a gas or liquid into the aqueous mobile zone may provide economical benefits.

The increased pressure exerted by the aqueous mobile zone may result from recharge of the aqueous mobile zone by surface waters that are in fluid communication with the aqueous mobile zone. For example, the surface waters may produce an increase in pressure in the aqueous mobile zone due to gravitational forces exerted on the surface waters.

It is not necessary that the bitumen-depleted zone be completely depleted of bitumen. Accordingly, in the context of the present application, a bitumen-depleted zone would be understood to refer to a zone in the hydrocarbon reservoir where it is not commercially viable to continue to extract bitumen from the hydrocarbon reservoir, even though residual bitumen may be present in the hydrocarbon reservoir. In some hydrocarbon reservoirs, it may no longer be commercially viable to extract bitumen once the average residual oil saturation level is less than 40%. In other hydrocarbon reservoirs, it may no longer be commercially viable to extract bitumen once the average residual oil saturation level is less than 30%. In yet other hydrocarbon reservoirs, it may no longer be commercially viable to extract bitumen once the average residual oil saturation level is less than 20%. In some especially productive hydrocarbon reservoirs, it may no longer be commercially viable to extract bitumen once the average residual oil saturation level is less than 10-15%.

A hot bitumen-depleted zone is to be understood to refer to a bitumen-depleted zone whose temperature is elevated by heat used in a thermal bitumen-recovery process that generates the bitumen-depleted zone. In particular examples, the hot bitumen-depleted zone is generated by steam-assisted gravity drainage, in situ combustion, a solvent aided thermal recovery process, electric heating, electromagnetic heating, or any combination thereof.

In some examples, the hot bitumen-depleted zone has an average temperature of at least 10° C. For example, the hot bitumen-depleted zone may have an average temperature of between 20 and 300° C. when the hot bitumen-depleted zone is generated by steam-assisted gravity drainage. In another example, the hot bitumen-depleted zone may have an average temperature of between 20 and 600° C. when the hot bitumen-depleted zone is generated by in situ combustion. In yet another example, the hot bitumen-depleted zone may have an average temperature of between 20 and 400° C. when the hot bitumen-depleted zone is generated by electromagnetic heating.

Regardless of the thermal bitumen recovery method used to generate the hot bitumen-depleted zone, some hot bitumen-depleted zones may have conditions that generate steam when the water is driven from the aqueous mobile zone through at least a portion of the hot bitumen-depleted zone; while other hot bitumen-depleted zones may have conditions that generate hot liquid water when the water is driven from the aqueous mobile zone through at least a portion of the hot bitumen-depleted zone. A hot bitumen-depleted zone may, at a specific point in time, have conditions that generate steam when the water is driven from the aqueous mobile zone through at least a portion of the hot bitumen-depleted zone, and, at a later point in time, may have conditions that generate hot liquid water when the water is driven from the aqueous mobile zone through at least a portion of the hot bitumen-depleted zone.

When generating steam in the hot bitumen-depleted zone, it is desirable to place the heated water production well above at least a portion of the hot bitumen-depleted zone. In such a manner, the water from the aqueous mobile zone may be driven though the portion of the hot-bitumen depleted zone below the heated water production well and turned into steam, which rises up to the heated water production well.

It is not necessary for the heated water production well to be placed above at least a portion of the hot bitumen-depleted zone. Steam may be driven from an upper portion of the hot bitumen-depleted zone downwards to a heated water production well placed below at least a portion of the hot bitumen-depleted zone. Alternatively, steam may be driven substantially across a portion of the hot bitumen-depleted zone to a heated water production well that is at substantially the same level as the aqueous mobile zone. The steam may be produced from the heated water production well as steam or as hot liquid water.

When generating hot liquid water in the hot bitumen-depleted zone, it is desirable to place the heated water production well below at least a portion of the hot bitumen-depleted zone. In such a manner, the water from the aqueous mobile zone may be driven though the portion of the hot-bitumen depleted zone above the heated water production well and turned into hot liquid water, which descends due to gravity to the heated water production well.

It is not necessary for the heated water production well to be placed below at least a portion of the hot bitumen-depleted zone. Liquid water may be driven from a lower portion of the hot bitumen-depleted zone upwards to a heated water production well placed above at least a portion of the hot bitumen-depleted zone. Alternatively, liquid water may be driven substantially across a portion of the hot bitumen-depleted zone to a heated water production well that is at substantially the same level as the aqueous mobile zone.

In some examples, driving the water from the aqueous mobile zone through at least a portion of the hot bitumen-depleted zone may heat the water sufficiently to generate both steam and hot liquid water in situ. When generating both steam and hot liquid water, the method may include producing heated water from a first and a second heated water production well. In such situations, the first heated water production well is located above at least a portion of the hot bitumen-depleted zone; and the second heated water production well is located below at least a portion of the hot bitumen-depleted zone. The water from the aqueous mobile zone is driven though a portion of the hot-bitumen depleted zone below the first heated water production well and above the heated water production well, and the first heated water production well produces heated water from the generated steam, and the second heated water production well produces water from the generated hot liquid water.

The expression "heated water" should be understood to mean water that is at a temperature higher than the temperature of the aqueous mobile zone. Heated water may be liquid water, or steam. The steam may be saturated steam (or "wet steam"), or superheated steam (or "dry steam"). Saturated steam could be considered to be a mixture of liquid water and water vapor.

Since both temperature and pressure affect whether the heated water is a hot liquid water or steam, water that is driven through a hot bitumen-depleted zone as liquid water may be produced at the heated water production well as steam. Accordingly, it is the conditions in the hot bitumen-depleted zone that would determine whether steam or hot liquid water is being driven through the portion of the hot-bitumen depleted zone. In the context of the present disclosure, it should be understood that reservoir conditions may promote the co-existence of both steam and liquid water. It should be understood that the term "steam" includes: water vapor in a vapor-liquid equilibrium (also referred to as "saturated steam" or "wet steam"), and a water vapor that is at a temperature higher than its boiling point for the pressure, which occurs when all the liquid water has evaporated or has been removed from the system (also referred to as "superheated steam" or "dry steam").

Hot bitumen-depleted zones that have conditions that generate steam in the hot bitumen-depleted zone may, after thermal energy is removed from the hot bitumen-depleted zone, have conditions that generate hot liquid water in the hot bitumen-depleted zone. The method may use a first heated water production well that is located above at least a portion of the hot bitumen-depleted zone when the hot bitumen-depleted zone has conditions that generate steam, and a second heated water production well that is located below at least a portion of the hot bitumen-depleted zone when the hot bitumen-depleted zone has conditions that generate hot liquid water.

EXAMPLES

A simulation of a process according to the present disclosure reservoir was performed. In the simulation, the bitumen is located above an aqueous mobile zone. Bitumen is produced via steam-assisted gravity drainage for a period of 6 years. At the end of 6 years, water from the aqueous mobile zone is driven up, through the hot bitumen depleted zone, and produced from a heated water production well that is located in the top portion of the reservoir.

An illustration of the simulated reservoir is shown in FIG. 1. The grayscale indicates the water saturation in each simulated cell, with black representing maximum water saturation and white representing minimum water saturation.

The simulated well is shown over time in FIGS. 2-6. In figures "A", the grayscale indicates the temperature of each simulated cell, with black representing an elevated temperature and white representing a reduced temperature. In figures "B", the grayscale indicates the water saturation in each simulated cell, with black representing maximum water saturation and white representing minimum water saturation.

Figure 2A:
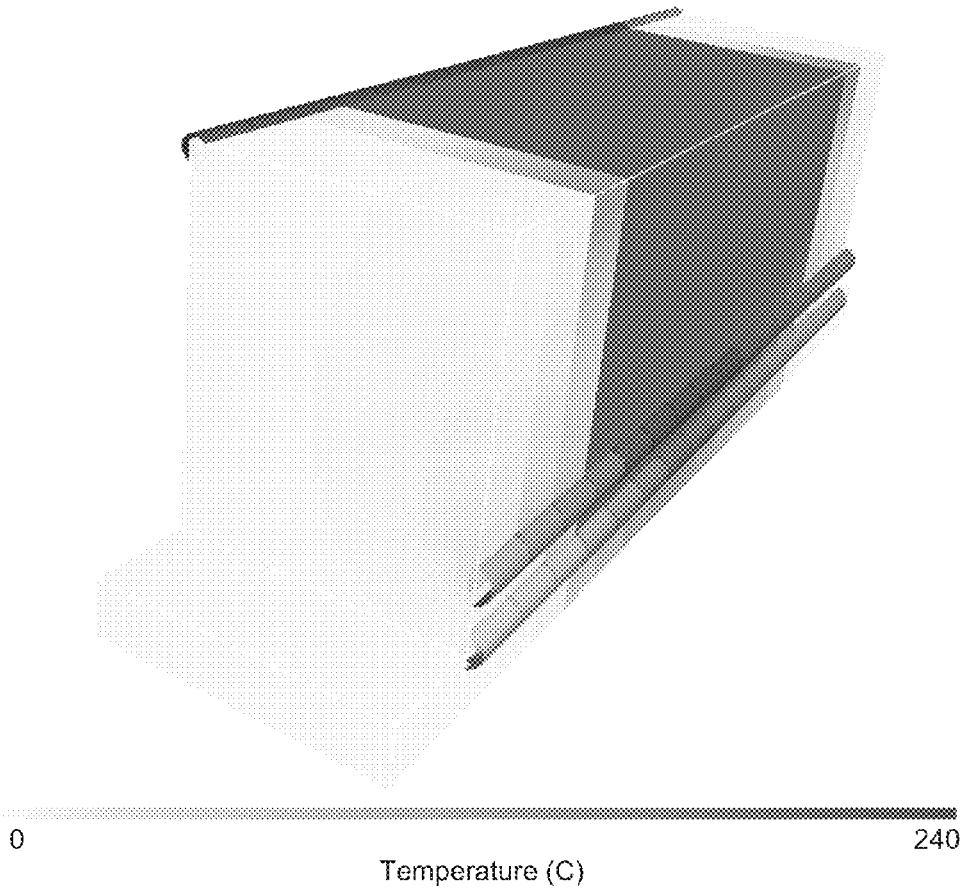
FIG. 2A is an illustration of the simulated reservoir after 6 years of SAGD bitumen production, with the grayscale illustrating the temperature of each simulated cell.
Figure 2B:
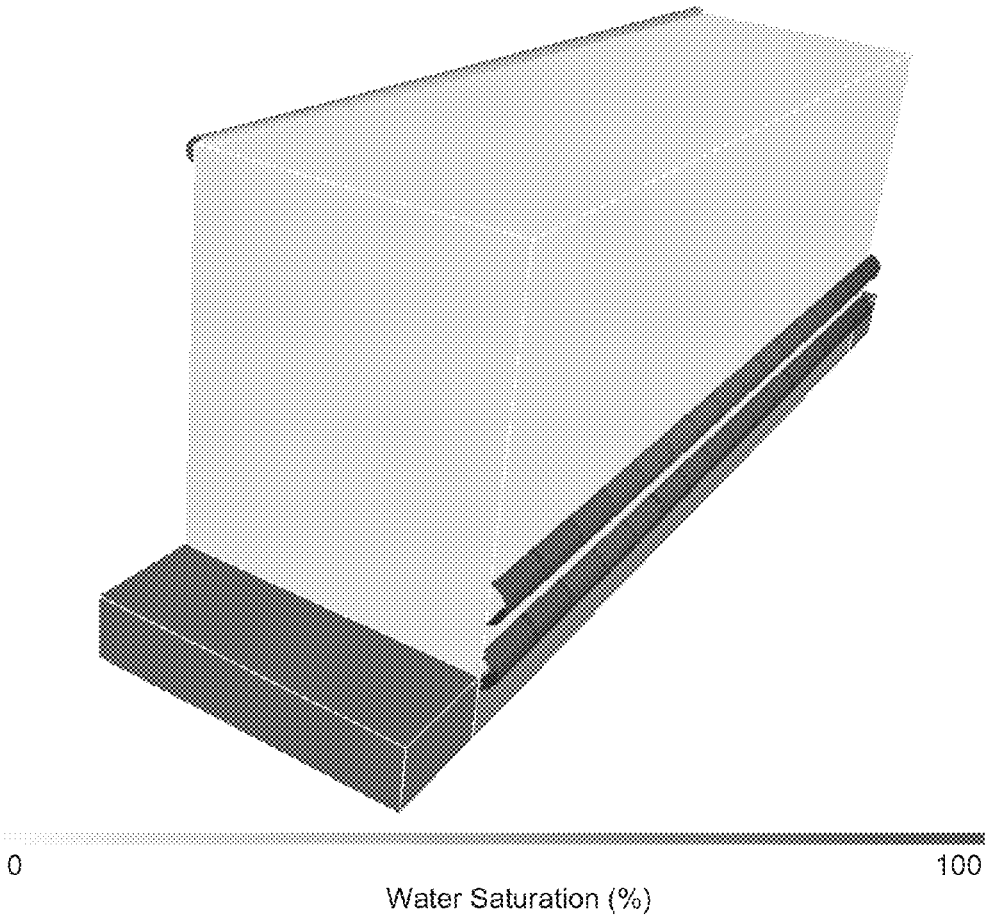
FIG. 2B is an illustration of the simulated reservoir after 6 years of SAGD bitumen production, with the grayscale illustrating the water saturation of each simulated cell.
Figure 3A:
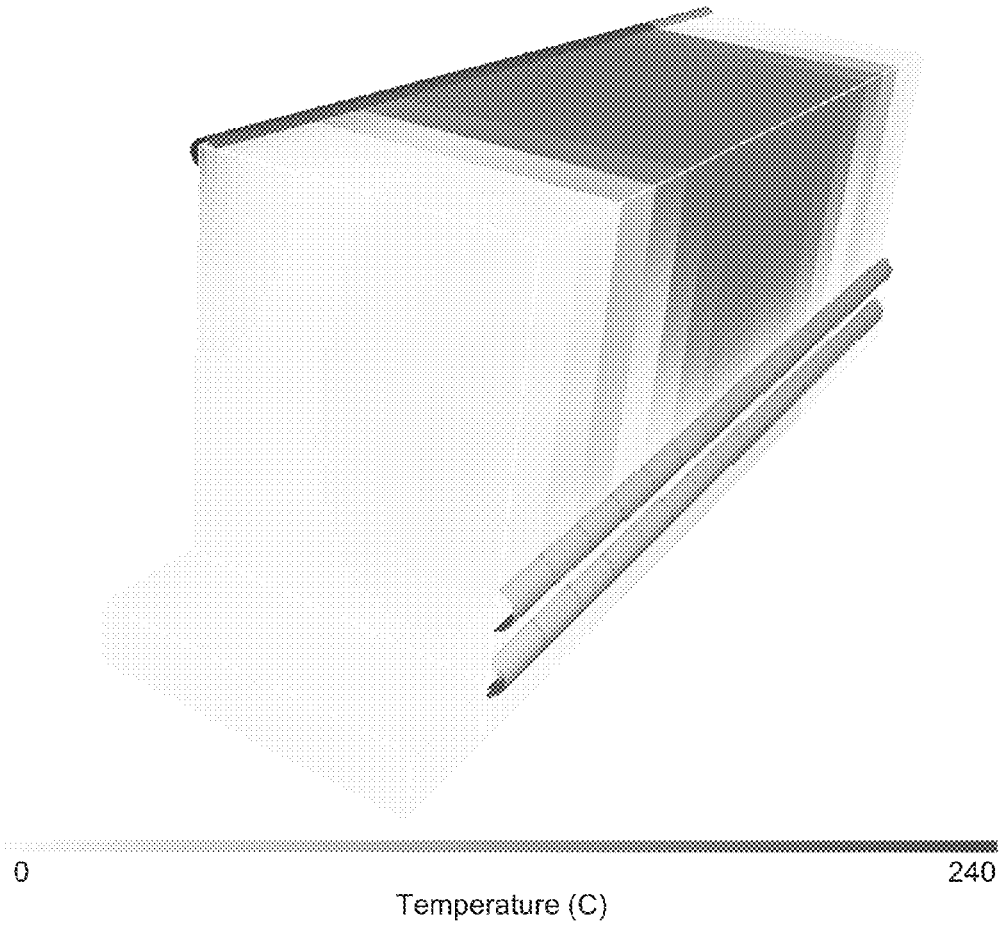
FIG. 3A is an illustration of the simulated reservoir after 1 year of heated water production, with the grayscale illustrating the temperature of each simulated cell.
Figure 3B:
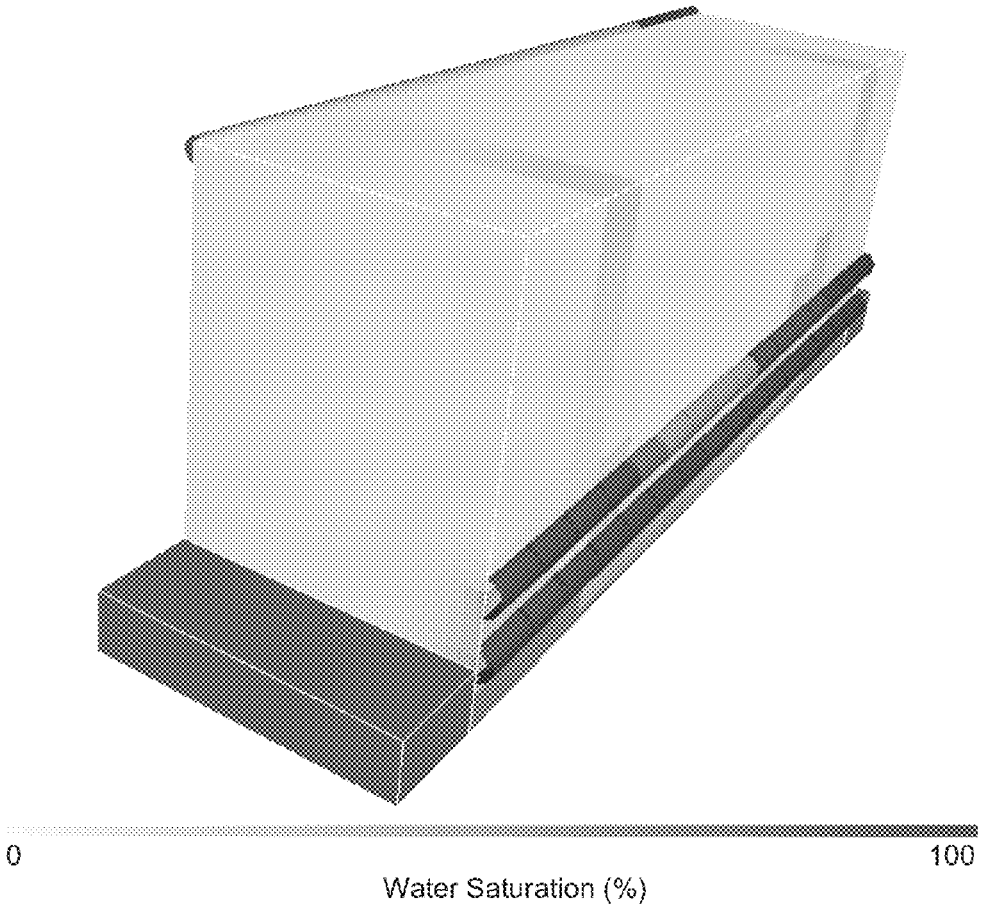
FIG. 3B is an illustration of the simulated reservoir after 1 year of heated water production, with the grayscale illustrating the water saturation of each simulated cell.
Figure 4A:
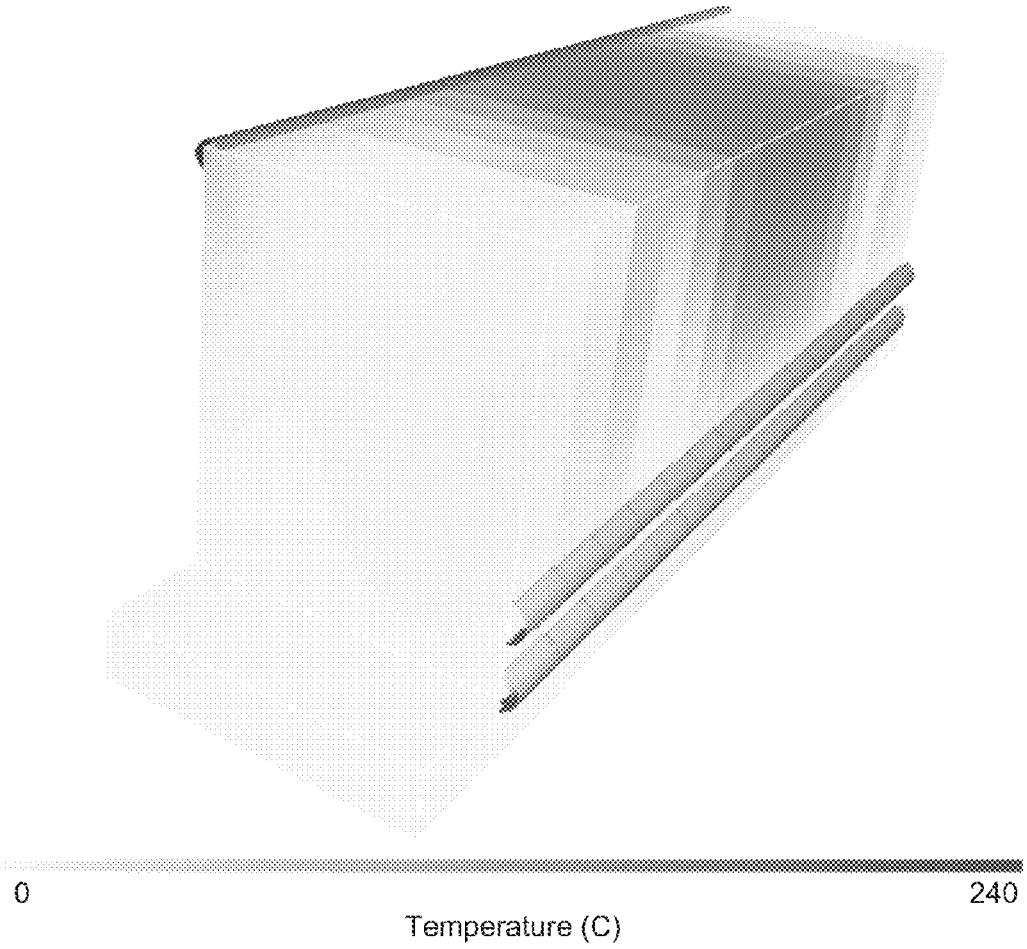
FIG. 4A is an illustration of the simulated reservoir after 2 years of heated water production, with the grayscale illustrating the temperature of each simulated cell.
Figure 4B:
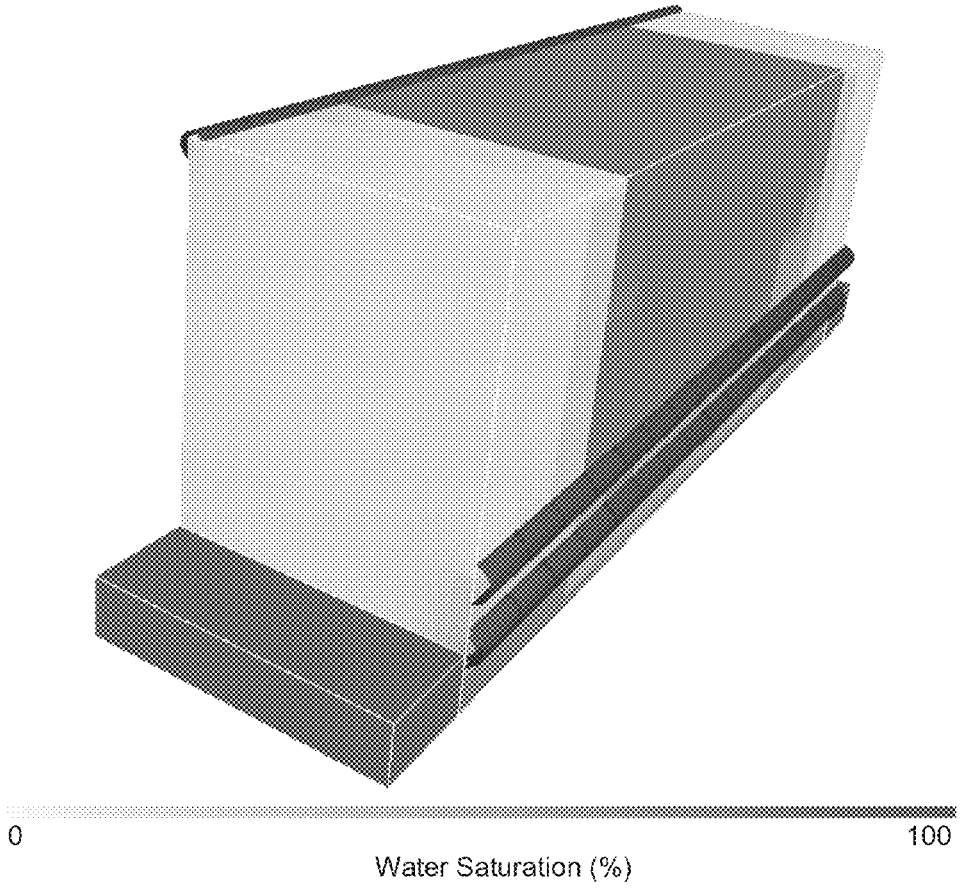
FIG. 4B is an illustration of the simulated reservoir after 2 years of heated water production, with the grayscale illustrating the water saturation of each simulated cell.
Figure 5A:
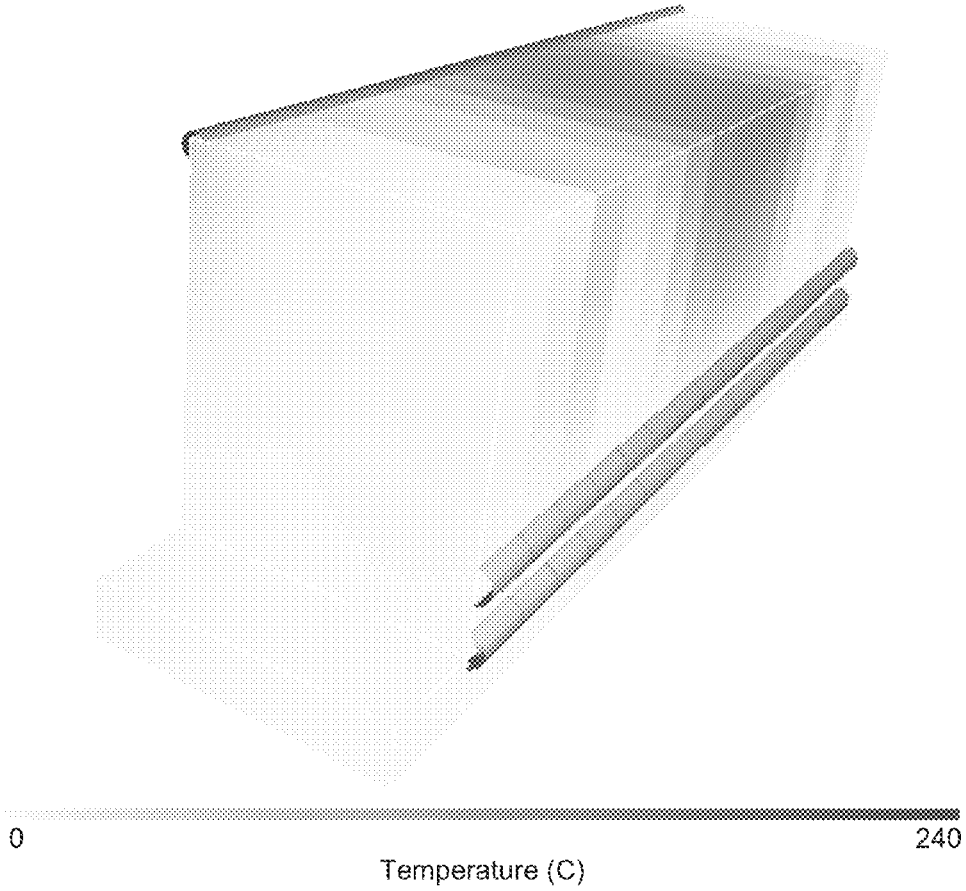
FIG. 5A is an illustration of the simulated reservoir after 3 years of heated water production, with the grayscale illustrating the temperature of each simulated cell.
Figure 5B:
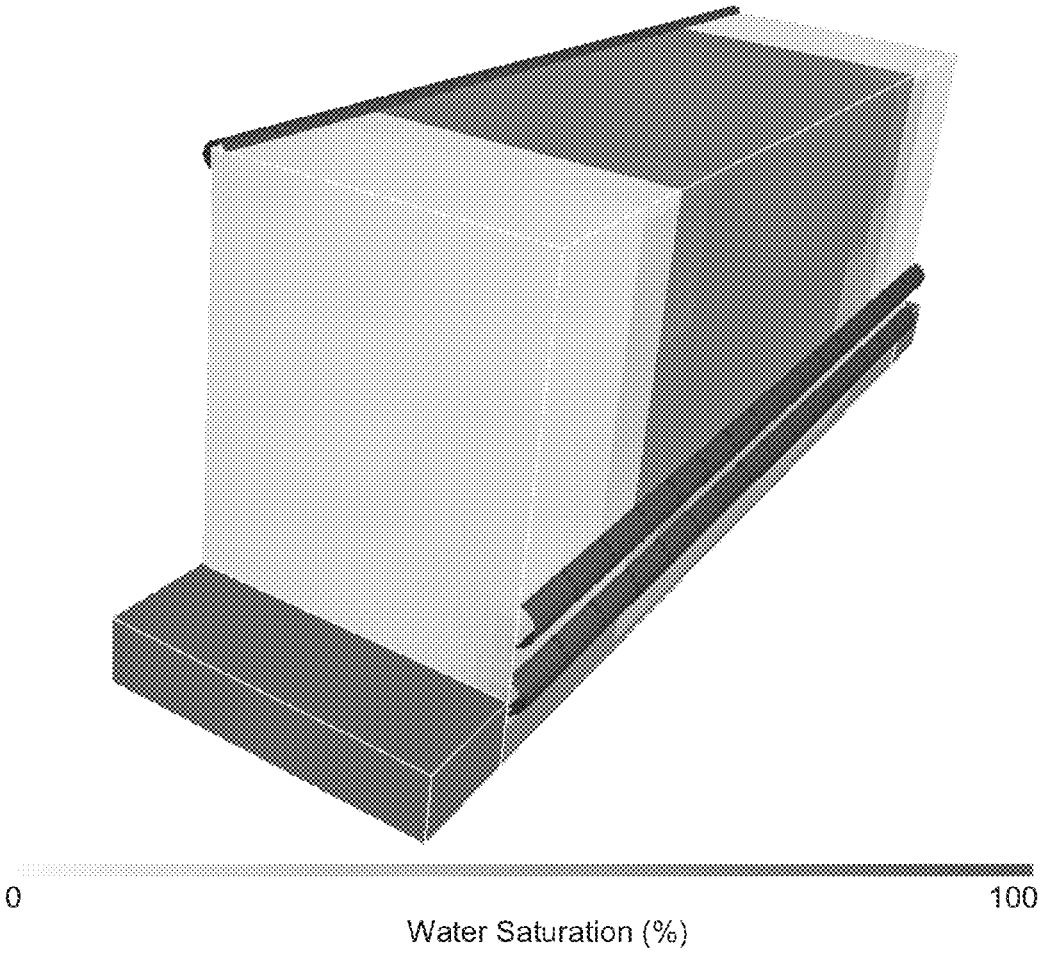
FIG. 5B is an illustration of the simulated reservoir after 3 years of heated water production, with the grayscale illustrating the water saturation of each simulated cell.
Figure 6A:
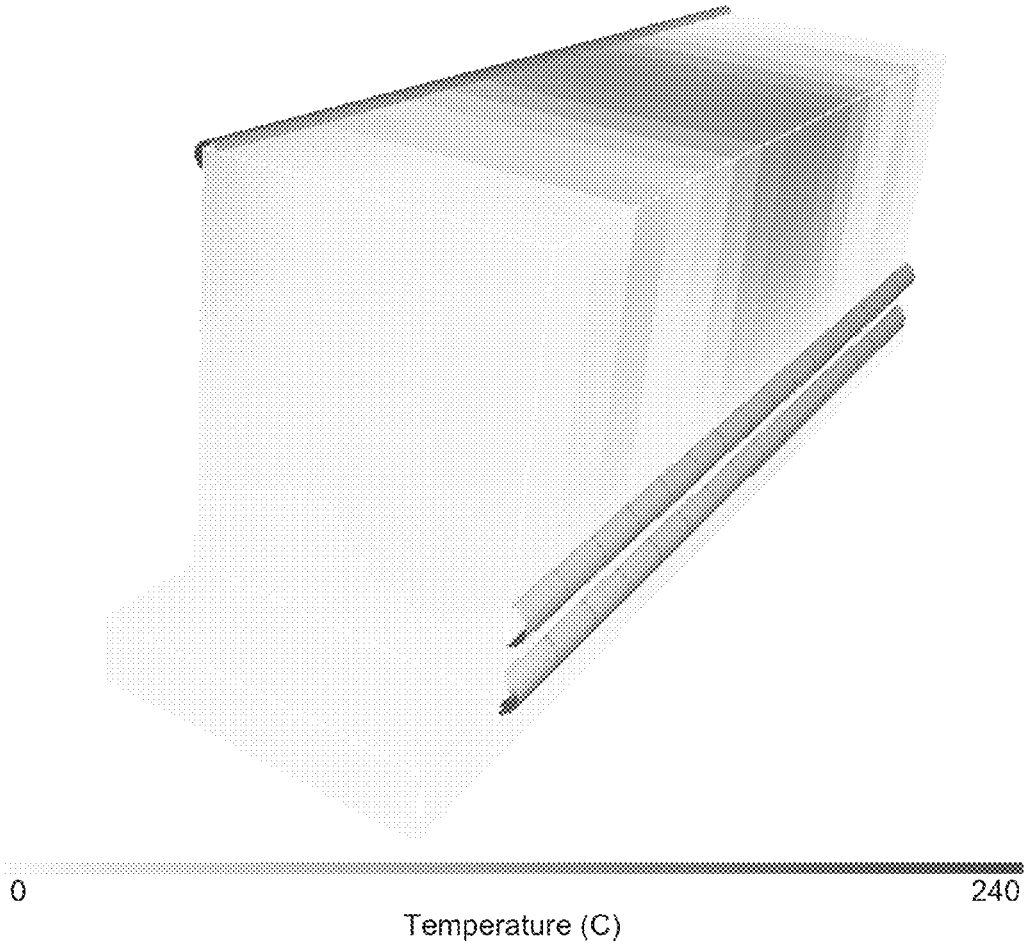
FIG. 6A is an illustration of the simulated reservoir after 3.2 years of heated water production, with the grayscale illustrating the temperature of each simulated cell.
Figure 6B:
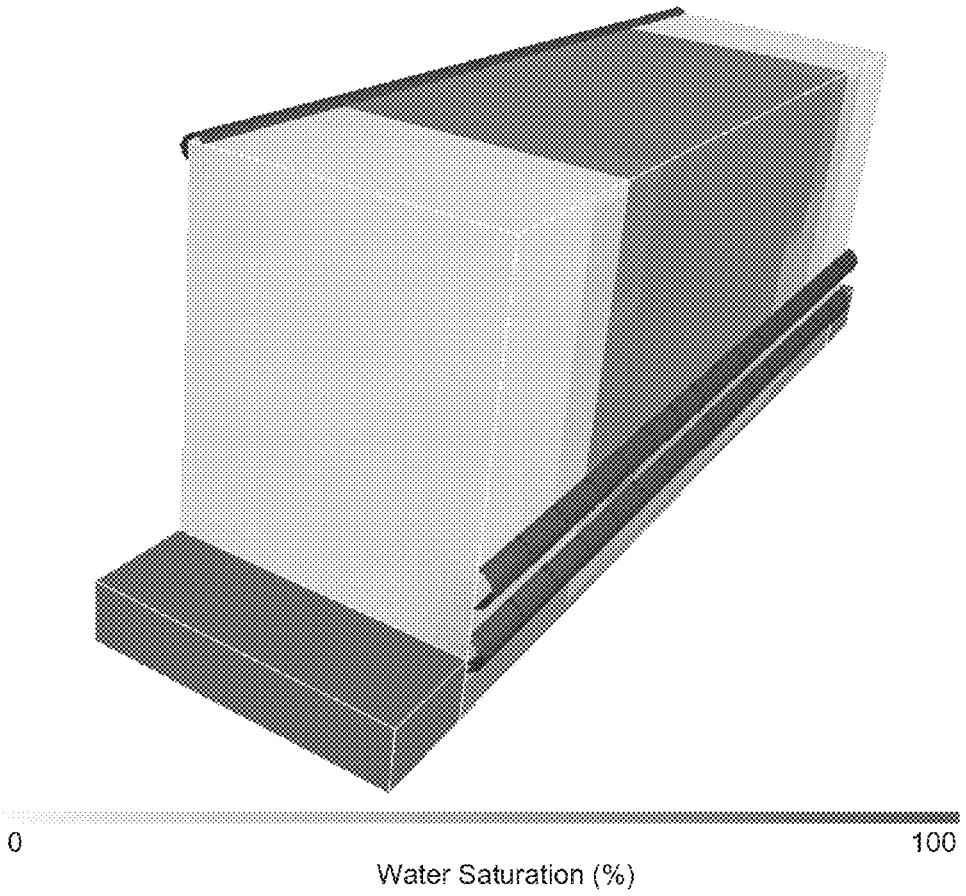
FIG. 6B is an illustration of the simulated reservoir after 3.2 years of heated water production, with the grayscale illustrating the water saturation of each simulated cell.

FIG. 2 illustrates the reservoir after steam assisted gravity drainage is stopped. FIG. 3 illustrates the reservoir after 1 year of heated water production. FIG. 4 illustrates the reservoir after 2 years of heated water production. FIG. 5 illustrates the reservoir after 3 years of heated water production. FIG. 6 illustrates the reservoir after 3.2 years of heated water production.

As may be seen from the simulated process, after SAGD the heated water production well is opened and water from the aquifer in the bottom portion of the reservoir starts flowing upwards through the hot depleted bitumen zone and gets heated, thereby cooling the reservoir in return. In this simulation, the heated water production well was operated until the produced fluids were at a temperature of 90° C.

Figure 7:
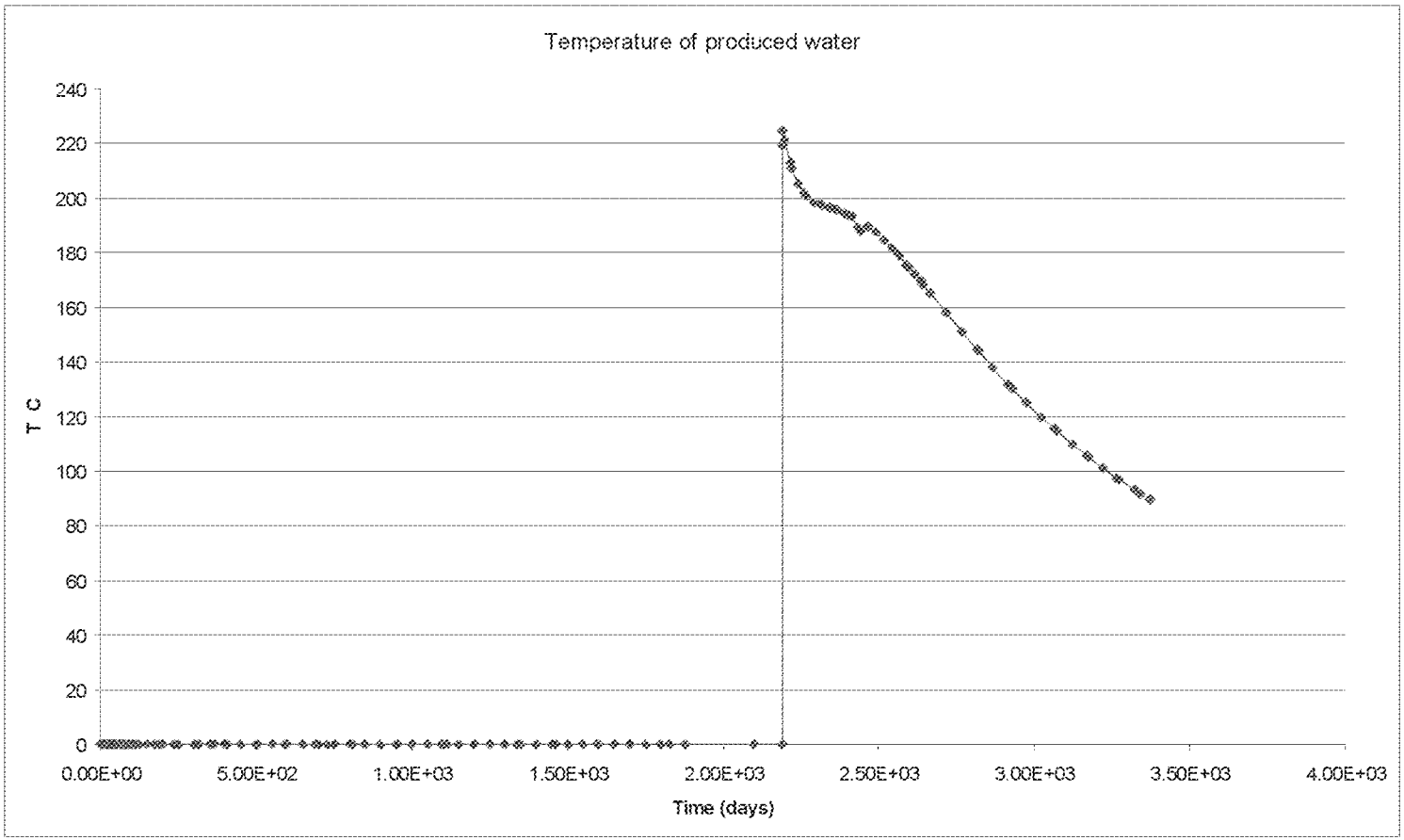
FIG. 7 is a graph that illustrates the temperature of the produced water over time.

A graph showing the temperature of the produced water over time is shown in FIG. 7. A graph showing the energy inputted and recovered over time is shown in FIG. 8.

Figure 8:
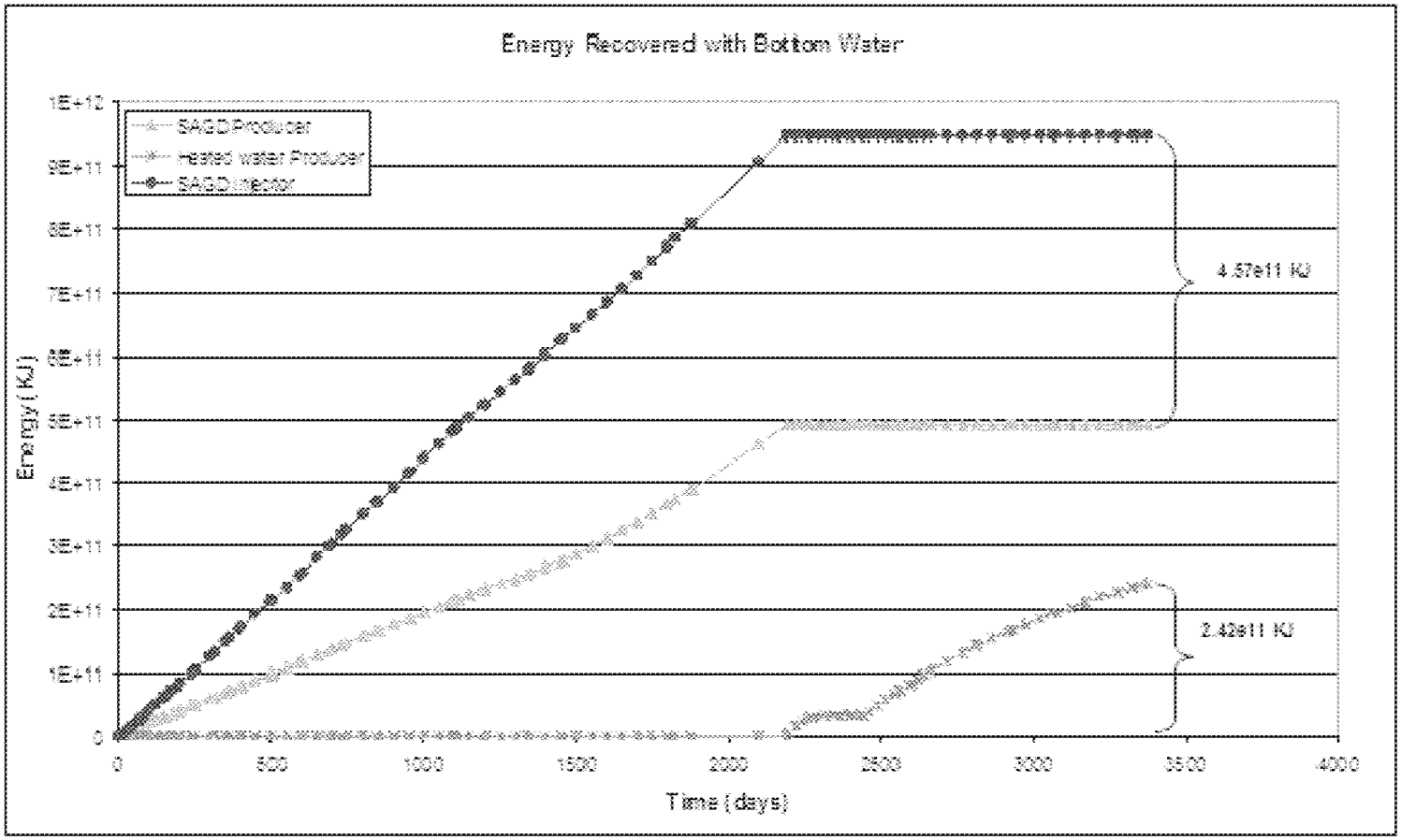
FIG. 8 is a graph that illustrates the energy inputted and recovered over time.

As indicated in FIG. 8: at the end of six years of SAGD, the cumulative energy injected into the reservoir by SAGD is 9.47e11 kJ; and the cumulative energy produced by the SAGD is 4.9e11 kJ. The difference between the amount of energy injected by the SAGD injector and the amount of energy produced by the SAGD producer was 4.57e11 kJ. A total of 359,647 tons of water was produced over the course of 3.23 years, at an average water production rate of 400 t/day. The cumulative energy produced by the heated water production well was 2.4e11 kJ.

In the preceding description, for purposes of explanation, numerous details are set forth in order to provide a thorough understanding of the examples. However, it will be apparent to one skilled in the art that these specific details are not required. The above-described examples are intended to be exemplary only. Alterations, modifications and variations can be effected to the particular examples by those of skill in the art without departing from the scope, which is defined solely by the claims appended hereto.

What is claimed is:

1. A method of producing heated water from a hydrocarbon reservoir having a hot bitumen-depleted zone adjacent to an aqueous mobile zone formation, the method comprising:

generating fluid communication between the aqueous mobile zone formation and the hot bitumen-depleted zone;

driving water from the aqueous mobile zone formation through at least a portion of the hot bitumen-depleted zone to heat the water sufficiently to generate both steam and hot liquid water in situ; and producing the heated water from a first and a second heated water production well, wherein:

the first heated water production well is located above at least a portion of the hot bitumen-depleted zone; and the second heated water production well is located below at least a portion of the hot bitumen-depleted zone; and the water from the aqueous mobile zone formation is driven through a portion of the hot bitumen-depleted zone below the first heated water production well and above the second heated water production well, and the first heated water production well produces heated water from the generated steam, and the second heated water production well produces water from the generated hot liquid water.

2. A method of producing heated water from a hydrocarbon reservoir having a hot bitumen-depleted zone adjacent to an aqueous mobile zone formation, wherein the hot bitumen-depleted zone is separated from the aqueous mobile zone formation by a geological barrier, the method comprising:

generating fluid communication between the aqueous mobile zone formation and the hot bitumen-depleted zone by modifying the geological barrier to allow water from the aqueous mobile zone formation to flow through the modified geological barrier;

driving water from the aqueous mobile zone formation through at least a portion of the hot bitumen-depleted zone to heat the water; and producing the heated water from a heated water production well.

3. The method according to claim 2, further comprising:

generating the hot bitumen-depleted zone using steam-assisted gravity drainage, in situ combustion, steam flooding, cyclic steam stimulation, a solvent aided thermal recovery process, electric heating, electromagnetic heating, or any combination thereof.

4. The method according to claim 2, wherein driving the water from the aqueous mobile zone formation through at least a portion of the hot bitumen-depleted zone heats the water sufficiently to generate steam in situ.

5. The method according to claim 4, wherein the heated water production well is located above at least a portion of the hot bitumen-depleted zone, and the water from the aqueous mobile zone formation is driven through the portion of the hot bitumen-depleted one below the heated water production well.

6. The method according to claim 2, wherein driving the water from the aqueous mobile zone formation through at least a portion of the hot bitumen-depleted zone heats the water sufficiently to generate hot liquid water in situ.

7. The method according to claim 6 wherein the heated water production well is located below at least a portion of the hot bitumen-depleted zone, and the water from the aqueous mobile zone formation is driven through the portion of the hot bitumen-depleted zone above the heated water production well.

8. The method according to claim 2, wherein driving the water from the aqueous mobile zone formation through at least a portion of the hot bitumen-depleted zone heats the water sufficiently to generate both steam and hot liquid water in situ.

9. The method according to claim 2, comprising applying a pressure difference between the aqueous mobile zone formation and the heated water production well to drive the water from the aqueous mobile zone formation through the at least a portion of the hot bitumen-depleted zone.

10. The method according to claim 9, wherein the pressure difference is applied by: injecting a gas or liquid into the aqueous mobile zone formation, reducing the pressure at the heated water production well, an increased pressure exerted by the aqueous mobile zone formation, gravity, or any combination thereof.

11. The method according to claim 2, wherein the method avoids injection of a gas or liquid into the aqueous mobile zone formation.

12. The method according to claim 2 wherein the geological barrier comprises a lithology contrast, a fault, a fluid compositional gradient, a tar mat, a rock formation, bitumen, a viscous fluid barrier, or any combination thereof.

13. The method according to claim 12, wherein the geological barrier comprises a fluid compositional gradient.

14. The method according to claim 12, wherein the geological barrier comprises a viscous fluid barrier.

15. The method according to claim 2, wherein the geological barrier is a rock formation and modifying the geological barrier comprises fracturing a sufficient portion of the rock formation to allow water from the aqueous mobile zone formation to flow to the hot bitumen-depleted zone.

16. The method according to claim 2, wherein the geological barrier comprises bitumen and modifying the geological barrier comprises sufficiently decreasing the viscosity of the bitumen so that water from the aqueous mobile zone formation is flowable through the geological barrier to the hot bitumen-depleted zone.

17. The method according to claim 2, wherein modifying the geological barrier comprises drilling a well that generates the fluid communication between the aqueous mobile zone formation and the hot bitumen-depleted zone.

18. The method according to claim 2, wherein the aqueous mobile zone formation is an aquifer or water-filled rock formation.

* * * * *